United States Patent [19]

Gabriels

[11] Patent Number: 4,920,886

[45] Date of Patent: May 1, 1990

[54] ANTI-VEHICLE GRENADE

[75] Inventor: A. Gabriels, Genk, Belgium

[73] Assignee: Fabrique Nationale Herstal Societe Anonyme, en abrege "FN", Herstal, Belgium

[21] Appl. No.: 250,715

[22] Filed: Sep. 29, 1988

[30] Foreign Application Priority Data

Sep. 30, 1987 [BE] Belgium ..... 8701106

[51] Int. Cl.[5] ..... F42B 11/22

[52] U.S. Cl. ..... 102/476; 102/484; 102/487; 102/499

[58] Field of Search ..... 102/305-310, 102/475, 476, 487, 488, 489, 499, 500, 483, 484, 485

[56] References Cited

U.S. PATENT DOCUMENTS

| | | | |
|---|---|---|---|
| 2,772,635 | 12/1956 | Brandt | 102/476 |
| 3,111,055 | 3/1967 | Stresau, Jr. et al. . | |
| 3,170,402 | 2/1965 | Morton et al. . | |
| 3,561,361 | 2/1971 | Kessenich et al. . | |
| 3,855,933 | 12/1974 | Messineo | 102/476 |
| 4,145,972 | 3/0019 | 79Menz et al. . | |
| 4,230,042 | 10/1980 | Popovitch | 102/233 |
| 4,282,814 | 8/1981 | Menz et al. | 102/499 |
| 4,394,836 | 7/1983 | Chavee et al. . | |
| 4,579,059 | 4/1986 | Flatau | 102/476 |
| 4,771,696 | 9/1988 | Smolnik | 102/473 |
| 4,784,062 | 11/1988 | Rudolf et al. | 102/476 |

FOREIGN PATENT DOCUMENTS

| | | | |
|---|---|---|---|
| 2498313 | 7/1982 | France | 102/306 |

*Primary Examiner*—Harold J. Tudor

*Attorney, Agent, or Firm*—Foley & Lardner, Schwartz, Jeffery, Schwaab, Mack, Blumenthal & Evans

[57] ABSTRACT

Anit-vehicle grenade of the type comprising a head (1) extended by a tubular tail (8), an axial bore (6) going through the head and running into the bore (7) of the tubular tail (9), characterized in that, between the safety device (3), respectively the detonator 4 placed assymmetrically with respect to the axis A—A of the grenade, on the one hand, and the hollow charge (2) of the grenade, on the other hand, means of transmission of the shock wave caused by the detonator (4) are mounted allowing to obtain a firing that is symmetrical about the axis of said hollow charge (2).

21 Claims, 3 Drawing Sheets

A
A-A
F5
II
III
IV
1
2
3
4
5
6
7
8
9
10
11
12
13
14
15
16
17
18
19
20
21
22
23
24
25
26
27
28
29
30
31

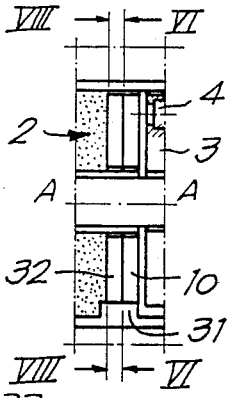
Fig.5
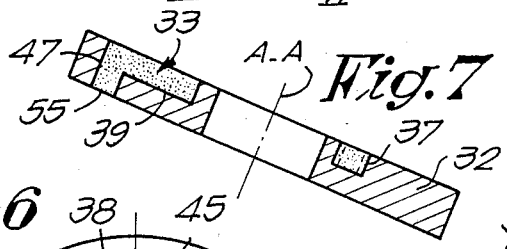
Fig.7
Fig.6
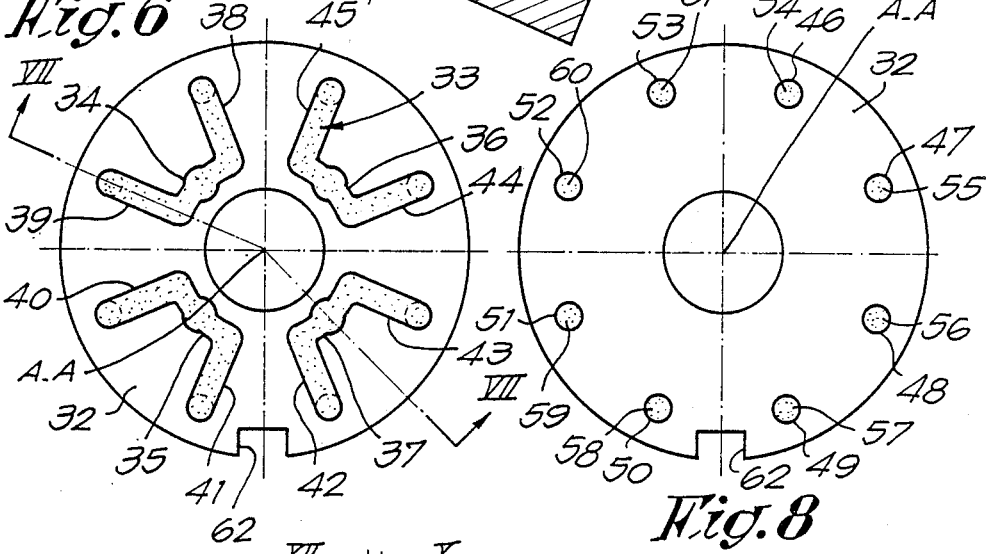
Fig.8
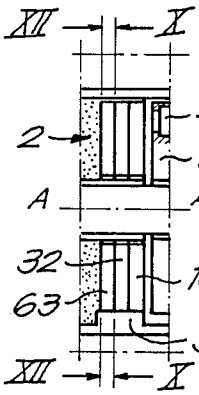
Fig.9

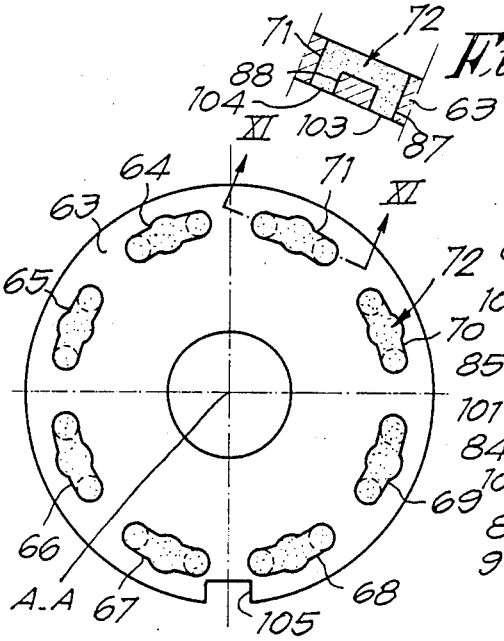
Fig. 11
Fig. 10
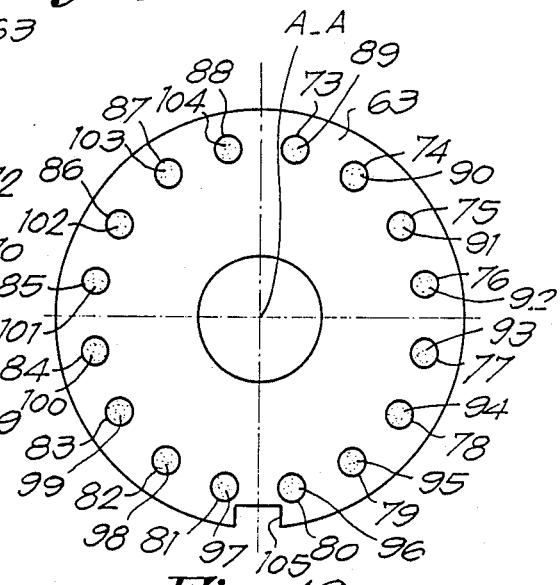
Fig. 12
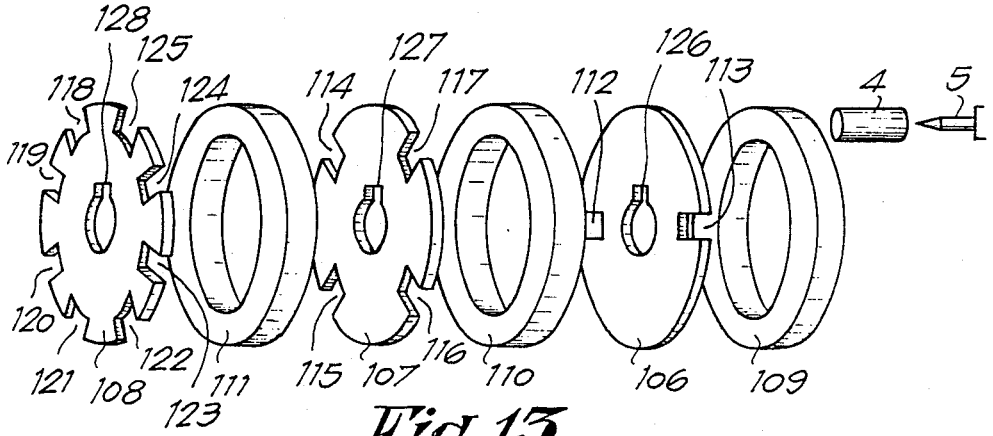
Fig. 13

ANTI-VEHICLE GRENADE

BACKGROUND OF THE INVENTION

1. Field of the Invention

The invention concerns an anti-vehicle grenade, in particular with a hollow charge, intended to be thrown by means of a rifle, and equipped with a "bullet-pass-through" device. This grenade can be of the telescopic type or not.

2. Discussion of the Related Art

It is known, that grenades of the above-mentioned type show a bore going through the grenade from one end to the other and allowing the bullet to pass.

It is also known that the use of a hollow charge requires a symmetrical firing. Now, the presence of the above mentioned central bore does not allow such a symmetrical firing, because the firing-pin is thrown off centre with respect to the longitudinal axis of the grenade.

SUMMARY OF THE INVENTION

The present invention hence aims to work out a hollow charge grenade intended to be thrown by means of a rifle and allowing a symmetrical firing of the hollow charge from a firing-pin that is thrown off centre.

To that effect, a grenade according to this invention, of a type comprising a head extended by a tubular tail, and with an axial bore going through both the head and the tail, is characterized in that, between the safety device, respectively the detonator placed asymetrically with respect to the axis A—A of the grenade, and the hollow load of the grenade, means of transmission of the shock wave caused by the detonator are mounted in order to obtain a firing that is symmetrical about the axis of said hollow charge.

As a mere illustration, by no means restrictive, examples of applications of the invention are described below, bearing reference to the attached drawings, in which:

BRIEF SUMMARY OF THE DRAWINGS

FIG. 5 shows another way of carrying out the part indicated in F5 of FIG. 1;

FIGS. 6 and 8 show sections along lines VI—VI and VIII—VIII of FIG. 5;

FIG. 7 shows a section along line VII—VII of FIG. 6;

FIG. 9 shows yet another way of carrying out the part indicated in F5 of FIG. 1;

FIGS. 10 and 12 show sections along lines X—X and XII—XII of FIG. 9;

FIG. 11 shows a section along line XI—XI of FIG. 10;

FIG. 13 shows in perspective an exploded view of another way of carrying out the present invention according to FIG. 9.

DETAILED DESCRIPTION OF THE PREFERRED EMBODIMENTS

Figures 1, 2, 3, 4:
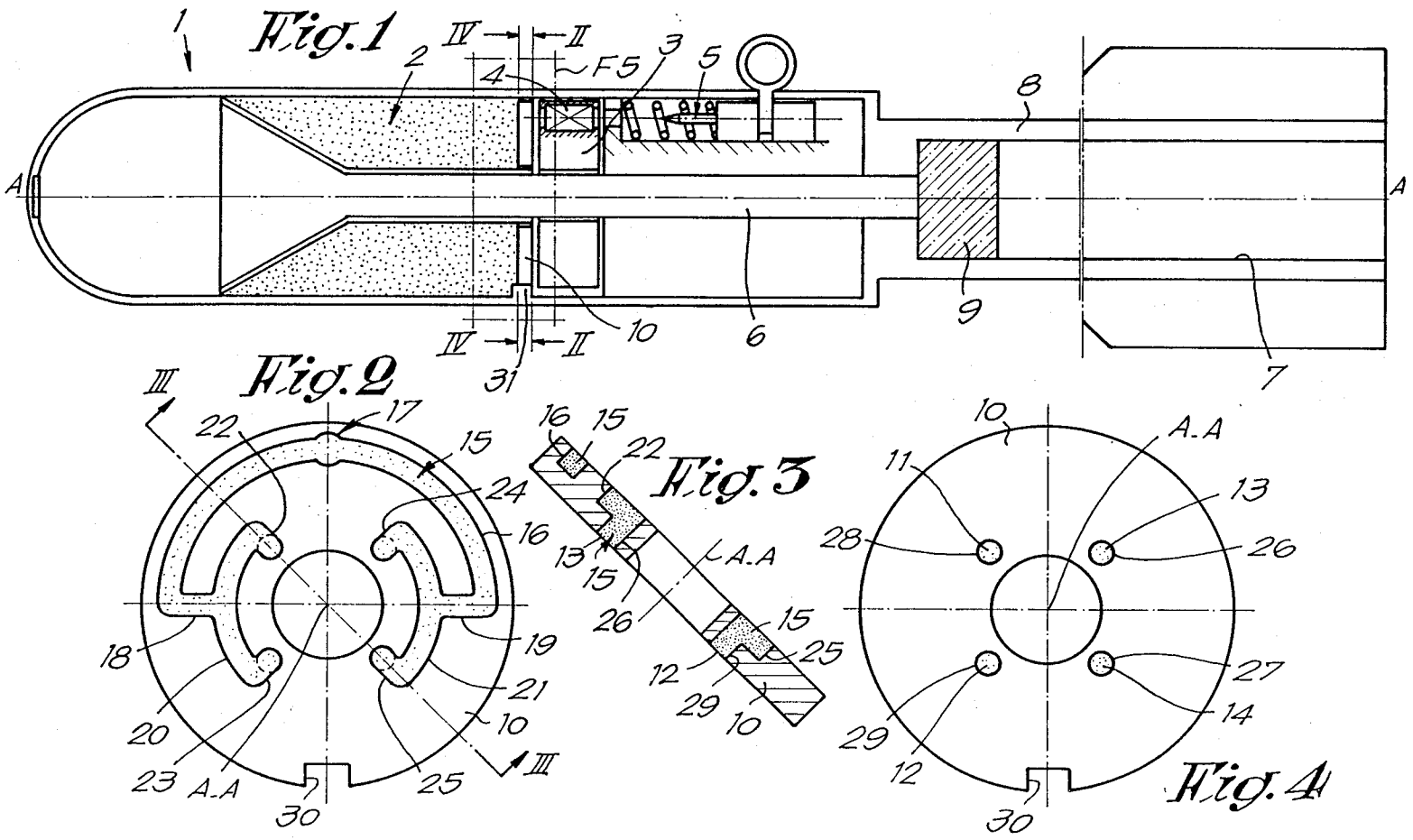
FIG. 1 shows a longitudinal section of an anti-vehicle grenade according to the invention.
FIGS. 2 and 4 show views, respectively along lines II—II and IV—IV of FIG. 1.
FIG. 3 shows a section along line III—III of FIG. 2.

FIG. 1 shows a grenade according to the invention, substantially made out of a head 1 comprising a hollow charge 2, a safety device 3 comprising the detonator 4 and a firing-pin device 5, an axial bore 6 going through the grenade and extended by a second axial bore 7 going through the tail 8 of the grenade.

In this bore 7 is mounted a "bullet-pass-through" device 9 as described in U.S. Pat. No. 4.394.836 of the applicant.

All these elements are known as such, and will hence not be described in detail.

In order to carry out a firing of hollow charge 2, the grenade comprises according to the invention, between safety device 3, especially detonator 4, and the actual hollow charge 2, a device 10 for transmitting the shock wave coming from the firing of detonator 4 towards hollow charge 2, for instance a disc 10. The latter is designed in such a way that it allows obtaining a symmetrical firing of the hollow charge.

In the examples of FIGS. 2 to 4, the transmission disc 10 is designed in a way to comprise four points of transmission, respectively 11, 12, 13 and 14, arranged in a concentric manner and at equal angles about the longitudinal axis A—A of the grenade.

To that effect, disc 10 comprises channels filled with an explosive substance 15.

A first channel 16 forms an orbit of 180 degrees, the half-way-point 17 of which is situated opposite said firing-pin and detonator 4.

This channel 16 is extended at each free end by channels 18–19 which are aligned and turned towards one another. Each channel 18–19 ends in a channel respectively 20–21, concentric to channel 16 and forming an orbit of 90 degrees, in particular of twice 45 degrees on each side of channels 18–19. Each free end of these two channels 20 and 21 is extended by radial channels, respectively 22, 23, 24, and 25 turned towards the axis A-A of the grenade, and each of these channels 22 to 25 communicates with one of the holes 26, 27, 28 and 29 which form the above mentioned points of transmission or of firing 11 to 14.

In order to correctly position disc 10 with respect to detonator 4, this disc is in the circumstances provided with a notch 30 devised to correspond with an inward lug 31 in the shell of the grenade; It is understood that the lengths of the constituent parts of the above mentioned channels must be absolutely identical and of equal length, in order to obtain a symmetrical firing, i.e. a firing of hollow charge 2 at the four points 11 to 14 at the same time.

Disc 10, especially the respective distance between the channels, and their depth compared with thickness of disc 10, are made in such a way that short-circuits are avoided between the neighbouring channels 16, 20 and 21 on the one hand, and between the explosive substance 15 and the hollow charge 2 at the places where the channels are, on the other hand.

The functioning of the grenade quipped with a disc 10 as described above is very simple and as follows.

When firing-pin 5 hits detonator 4, the resulting shock wave is transmitted to the explosive substance 15 contained in channel 16 of disc 10. The shock wave thus travels at the same time towards channels 18–19, then towards channels 20–21, next towards channels 22 to 25, hence ending, via the explosive substance contained in passages 26 to 29, onto hollow charge 2, if so desired via a classical relay.

It shall be observed that hollow charge 2 is thus fired symmetrically, to wit at the same moment in the four points 11 to 14 situated at equal angles with respect to one another.

In the example of FIG. 5, disc 10 has been doubled by a second disc 32, made in such a way that the shock waves coming from the four points 11 to 14 are transmitted to explosive substances 33 fitted in circular channels, respectively 34, 35, 36 and 37, made in disc 32.

Each of said channels 34 to 37 is, at each loose end, extended by radial channels, respectively 38–39, 40–41, 42–43 and 44–45, turned outwards. Each of the free ends of channels 38 to 45 communicate with holes 46 to 53, thus obtaining a multiplication of the points of firing 54 to 61. One of course obtains this way a better symmetrical distribution of the points of firing with respect to hollow charge 2. Said second disc is also provided with a positioning notch 62.

The functioning of the grenade equipped with discs 10 and 32 is similar to that described above. In this version the shock waves coming form points 11 to 14 are transmitted to the explosive substance 33 contained in channels 34 to 37. The shock waves travel at the same time towards channels 38 to 45 and then towards the explosive substance contained in passages 46 to 53, from where they are transmitted at the same time, at eight points, to hollow charge 2.

According to the invention, the measurements of the different channels are always fixed in such a way that the shock waves are transmitted simultaneously in the eight points 54 to 61 to the hollow charge.

In order to multiply even more said amount of points of firing, it is possible, as shown in FIG. 9, to further increase the amount of discs. So it is that a third disc 63 shows opposite each point of firing 54 to 61 a channel, respectively 64 to 71, concentric about the axis A—A of the grenade, and stretching over 22 degrees and 30 minutes. These channels are filled with an explosive substance 72. Each free end of these channels communicates with holes 73 to 88 existing in disc 63, in order to obtain in the circumstances sixteen points of firing, respectively 89 to 104.

One of course obtains this way a perfectly symmetrical firing, to wit at the same time at a considerable amount of points situated concentrically and at equal distances.

This disc 63 is provided with a positioning notch 105 corresponding with said lug 31 of the grenade.

In this example, the shock waves coming from points 54 to 61 are transmitted to the explosive substance 72 contained in channels 64 to 71 of disc 63. The shock waves travel through passages 73 to 88 in order to be transmitted, at sixteen points, to hollow charge 2.

One must observe that the distances that the shock wave must cover in the different channels of a disc 10, 32, 63, from its starting point up to the respective points of firing 11 to 14, 54 to 61 and 89 to 104 are strictly equal, in order to obtain in all circumstances a firing in all firing points simultaneously.

One could of course contemplate applying even more discs, and the form and the lay-out of the channels can of course vary according to the position of the firing-pin and of the available surface. Thus another variant of carrying out the invention is illustrated in FIG. 13.

In this variant, three disc 106, 107 and 108 are applied in the same way as in the previous examples, either alone or combined.

Each disc is preceded by a ring 109, 110 and 111 made of explosive substance. Disc 106 to 108 form as one might say barriers for the shock waves, and are provided with passages respectively 112–113, 114 to 117 and 118 to 125 towards hollow charge 2, in order to transmit the shock waves in a symmetrical and angular equidistant manner.

The correct positioning of the different discs with respect to one another can be obtained by notches or grooves 126, 127 and 128.

The functioning of this variant is identical to the one that is described higher up.

The above examples are of course merely described as illustrations, as the invention can be carried out in definitely different forms.

I claim:

1. An anti-vehicle grenade having a longitudinal axis, comprising:

a head portion;

a tubular tail portion extending along the longitudinal axis from said head portion;

said head and tail portions defining an axial bore therein;

a hollow explosive charge disposed in said head portion symmetrically about said axial bore;

a detonator disposed within said heat portion asymmetrically with respect to the longitudinal axis of the grenade; and means, disposed between said detonator and said hollow charge, for symmetrically firing the hollow charge;

said firing means comprising means for defining a conduction path for a shockwave caused by said detonator, the conduction path extending from an initial point adjacent said detonator to at least four firing points disposed symmetrically about the longitudinal axis of the grenade, wherein the conduction path distances from the initial point to each of the firing points are equal.

2. The anti-vehicle grenade according to claim 1, wherein said detonator forms part of a safety device disposed in said head portion between said hollow charge and said tail portion.

3. The anti-vehicle grenade according to claim 1, wherein said firing means comprises at least one disc disposed transversely of the longitudinal axis and defining said conduction path therein comprising channels filled with an explosive substance.

4. The anti-vehicle grenade according to claim 3, wherein the conduction path defined in said disc comprises a first channel adjacent the detonator forming a semi-circular path, two radially extending channels communicating with ends of the first channel, two curved channels in an arc of 90°, each communicating at a midpoint thereof with respective radially extending channels, and four channels communicating with respective ends of said two curved channels and with four holes forming said four firing points, said four holes extending through said disc.

5. The anti-vehicle grenade according to claim 4, wherein the detonator is located at the midpoint of the first channel.

6. The anti-vehicle grenade according to claim 3, further comprising means, provided on said disc, for positioning the disc with respect to the detonator.

7. The anti-vehicle grenade according to claim 6, wherein said positioning means is a notch formed on an outer edge of the disc.

8. The anti-vehicle grenade according to claim 1, wherein said firing means comprises two discs disposed transversely of the longitudinal axis and defining said conduction path therein comprising channels filled with an explosive substance.

9. The anti-vehicle grenade according to claim 1, wherein said firing means comprises three discs disposed transversely of the longitudinal axis and defining said conduction path therein comprising channels filled with an explosive substance.

10. The anti-vehicle grenade according to claim 8, wherein the portion of the conduction path defined in a first of said two discs comprises a first channel adjacent the detonator forming a semi-circular path, two radially extending channels communicating with ends of the first channel, two curved channels in an arc of 90°, each communicating at a midpoint thereof with respective radially extending channels, and four channels communicating with respective ends of said two curved channels and with four holes forming four intermediate firing points, said four holes extending through said disc; and wherein the portion of the conduction path defined in a second of said two discs comprises four curved channels disposed radially about said second disc, a midpoint of each of said four curved channels communicating with a respective one of said four intermediate firing points, eight outwardly radially extending channels communicating with respective ends of the four curved channels, radial endpoints of each of said eight outwardly radially extending channels communicating with eight holes forming eight firing points, said eight holes extending through said second disc.

11. The anti-vehicle grenade according to claim 1, wherein said firing means comprises two discs disposed transversely of the longitudinal axis and defining said conduction path therein.

12. The anti-vehicle grenade according to claim 11, wherein a first of said two discs has two diametrically opposed channels, and a second of said two discs has four symmetrically disposed channels.

13. The anti-vehicle grenade according to claim 12, wherein said channels form notches cut in the respective discs.

14. The anti-vehicle grenade according to claim 12, wherein the channels of said two discs are located adjacent a ring of explosive material.

15. The anti-vehicle grenade according to claim 12, wherein the channels of said first disc are spaced 90° from said detonator.

16. The anti-vehicle grenade according to claim 15, wherein the channels of said second disc are spaced 45° from the channels of said first disc.

17. The anti-vehicle grenade according to claim 9, wherein a portion of the conduction path defined in a first of said three discs comprises a first channel adjacent the detonator forming a semi-circular path, two radially extending channels communicating with ends of the first channel, two curved channels in an arc of 90°, each communicating at a midpoint thereof with respective radially extending channels, and four channels communicating with respective ends of said two curved channels and with four holes forming four initial firing points, said four holes extending through said first of said two discs;

wherein the portion of the conducting path forming a second of said two discs comprises four curved channels, disposed radially about said second disc, eight outwardly radially extending channels communicating with respective ends of the four curved channels, radial endpoints of each of said eight outwardly radially extending channels communicating with eight holes forming eight intermediate firing points, said eight holes extending through said second disc; and wherein the portion of the conduction path in a third of said three discs comprises eight curved channels, a free end of each of said eight curved channels communicating with a hole forming sixteen firing points, said sixteen holes extending through said third disc.

18. The anti-vehicle grenade according to claim 17, wherein a midpoint of each of said four curved channels of said second disc is disposed to communicate with a respective initial firing point of said first disc.

19. The anti-vehicle grenade according to claim 1 wherein said firing means comprises three discs disposed transversely of the longitudinal axis and defining said conduction path therein.

20. The anti-vehicle grenade according to claim 19, wherein each disc is disposed adjacent a ring of explosive material, said first disc has two diametrically opposed channels, said second disc has four symmetrical channels, and said third disc has eight symmetrical channels.

21. The anti-vehicle grenade according to claim 6, wherein said positioning means is a notch formed on an inner edge of the disc.

* * * * *